United States Patent [19]

Patterson, Jr. et al.

[11] 3,933,405

[45] Jan. 20, 1976

[54] ELECTRICAL CONNECTOR WITH DEFLECTABLE BUTT CONTACT TERMINAL

[75] Inventors: Charles A. Patterson, Jr., McDonald; Emil J. Tolnar, Jr., Warren, both of Ohio

[73] Assignee: General Motors Corporation, Detroit, Mich.

[22] Filed: May 16, 1974

[21] Appl. No.: 470,440

[52] U.S. Cl. ..... 339/48; 339/217 S

[51] Int. Cl.[2] ..... H01R 25/00

[58] Field of Search ..... 339/47–49, 339/126, 128, 217 S, 256 R, 256 C

[56] References Cited

UNITED STATES PATENTS

| | | | |
|---|---|---|---|
| 3,208,030 | 9/1965 | Evans et al. | 339/217 S X |
| 3,233,208 | 2/1966 | Ruehlemann et al. | 339/217 S X |
| 3,299,396 | 1/1967 | Kinkalb | 339/217 S X |

*Primary Examiner*—Joseph H. McGlynn
*Assistant Examiner*—Craig R. Feinberg
*Attorney, Agent, or Firm*—F. J. Fodale

[57] ABSTRACT

An electrical connector has a deflectable plate-like butt contact terminal portion carried at one end of a resiliently twistable, generally U-shaped channel which has its other end connected by a web to the mounting portion of the connector. The mounting portion of the connector is generally U-shaped and adapted to be mounted in a hole extending through a support panel. The butt contact terminal portion and channel may have a frontal area which is no greater than that of the mounting portion thereby reducing space requirements. The connector may conveniently be made by bending a sheet metal stamping.

1 Claim, 5 Drawing Figures

ELECTRICAL CONNECTOR WITH DEFLECTABLE BUTT CONTACT TERMINAL

This invention relates generally to electrical connectors and more particularly to electrical connectors having a deflectable butt contact terminal portion.

A typical use for an electrical connector having a deflectable butt contact terminal is in a lamp socket wherein the connector carrying an electrical lead is mechanically connected to the lamp socket and establishes electrical contact with a stud terminal of the lamp bulb through the butt contact terminal portion of the connector.

Another typical use of this type of electrical connector is in conjunction with an instrument panel wherein the electrical connector carrying an electrical lead is inserted in a hole in a support panel behind the instrument panel and mechanically connected to the support panel. The electrical connector thus secured establishes electrical contact with a stud terminal of an electrical instrument or the like carried by the instrument panel through the butt contact terminal portion.

Because of these typical uses, especially the latter, it is essential that the butt contact terminal portion be deflectable to allow for the variable positions that the stud terminal could take with respect to the connector due to manufacturing variations of the several parts which might be involved in the complete assembly.

The U.S. Pat. No. 2,982,939 issued to Robert E. Kirk on May 2, 1961 for a "Socket and Locking Means", discloses an electrical connector 12 having a butt contact terminal portion which is deflectable to accommodate the variable position that stud terminal 14*c* of the lamp bulb 14 takes due to manufacturing variations in the several parts of the assembly. The particular deflectable butt contact terminal portion disclosed takes the form of an elongated C-shaped leaf spring 12 connected at one end to a transverse arm 12*t* . A second curved arm 12*e* connected to the other end of the C-shaped leaf spring abuts the transverse arm. Such a connector has a major drawback in applications where space is a premium in that the butt contact terminal portion has a greatly elongated frontal area requiring elongated slots for inserting the terminal into the lamp socket. See FIG. 2 of the aforementioned Kirk patent.

It is generally an object of this invention to provide an electrical connector having a deflectable butt contact terminal portion which improves upon that shown in the Kirk patent by reducing the frontal area required while maintaining the same or greater deflection capabilities of the butt contact terminal portion.

Another object of this invention is to provide an electrical connector having a butt contact terminal portion which is deflectable toward the mounting portion by virtue of a torsionally resilient interconnecting channel portion which reduces the frontal area and consequently the space required by the connector.

Still another object of this invention is to provide an electrical connector having a deflectable butt contact terminal portion attached to a mounting portion of the terminal adapted to be mounted in a hole in a support panel which deflectable butt contact terminal portion may be designed to have a frontal area no greater than that of the mounting portion so that the connector may be inserted into the hole of the support panel terminal portion first without the hole being any larger than that required by the mounting portion which secures the terminal to the support panel by engaging portions of the support panel adjacent the hole.

Yet another object of this invention is to provide an electrical connector which may be stamped and bent from sheet metal so as to have a plate-like butt contact terminal portion which is deflectable toward the mounting portion by virtue of the torsional resilience of a plurality of legs in a channel which is bent from a flat strip portion of the sheet metal blank along its minimum thickness and which channel connects the plate-like butt contact terminal portion to the mounting portion.

Yet another object of this invention is to provide an electrical connector having a deflectable butt contact terminal which is plate-like and has a dished central portion adapted to universally adjust on the rounded contact surface of a stud connector which may be veriably positioned with respect to the connector because of manufacturing variations.

The exact nature of this invention as well as other objects and advantages thereof will be readily apparent from consideration of the following specification relating to the annexed drawings in which.

Figure 2:
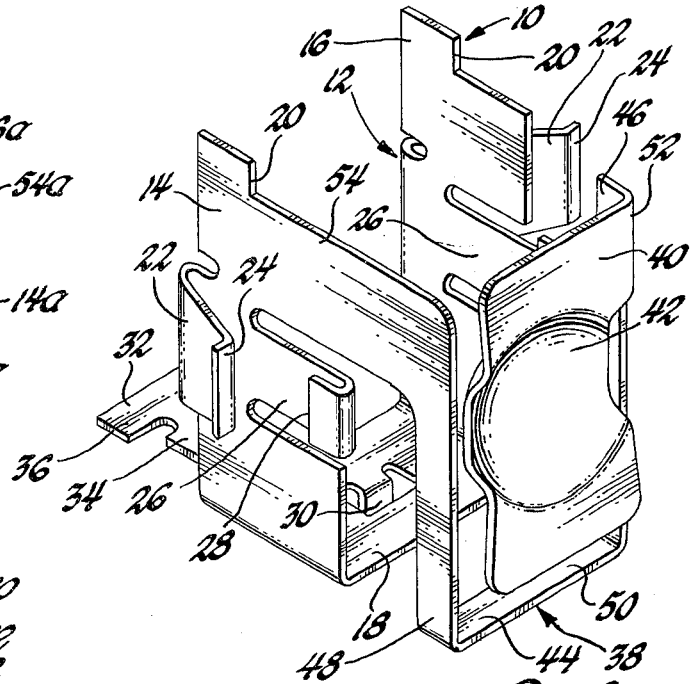
FIG. 2 is a perspective view of an electrical connector in accordance with this invention which has been bent to form from the sheet metal stamping shown in FIG. 1.

Referring now to the drawings and more particularly to FIG. 2, the electrical connector 10 comprises a generally U-shaped mounting portion 12 having two flat parallel legs 14 and 16 interconnected by a flat bottom leg 18. Each of the parallel legs have a stop shoulder 20 at their free ends and resilient wings 22 which are contiguous with their rear end and bent forwardly in a diverging relationship. The wings 22 terminate short lateral flanges 24 adapted to biasingly engage one side of a support panel. The parallel legs also have cutout spring arms 26 with reversely folded free ends which terminate in latch shoulders 28 adapted to engage the other side of the support panel. A cutout tab 30 bent downwardly from the bottom leg 18 has its forward face coplanar with the stop shoulders 20. The bottom leg 18 also has a contiguous rearwardly extending ferrule portion 32 of conventional design having two pairs of wings 34 and 36 which are adapted to be crimped onto the exposed end portion of an electrical lead and the insulator sheath therefor respectively.

The electrical connector 10 also includes terminal portion 38 comprising a plate-like butt contact terminal portion 40 having a centrally dished portion 42. The butt contact terminal portion 40 is perpendicular and connected to a U-shaped channel portion 44 having two flat parallel legs 46 and 48 interconnected by a flat bottom leg 50. The plate-like butt contact terminal 40 is within the frontal area defined by the channel portion 44 and connected thereto solely by bight portion 52 contiguous with the upper right hand corner of the terminal 40 and the free end of the channel leg 46. The channel portion 44 in turn is connected to the mounting portion 12 solely by a web 54 contiguous and coplanar with the free end portions of the legs 14 and 48 of the U-shaped mounting portion 12 and the U-shaped channel portion 44 respectively.

Figure 3:
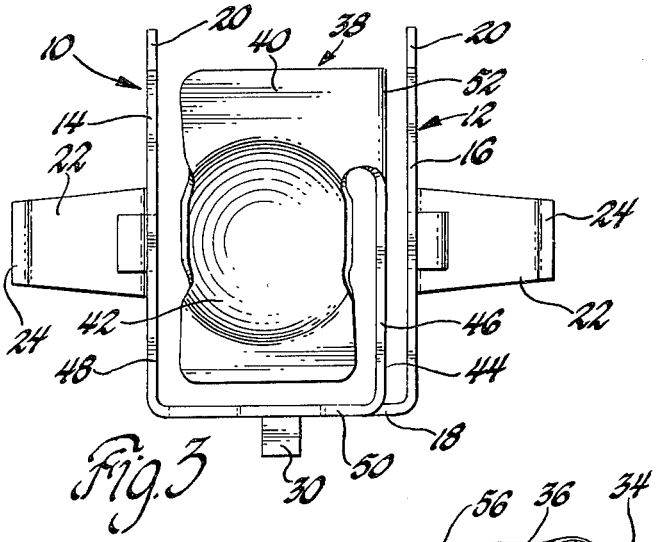
FIG. 3 is a front view of the electrical connector shown in FIG. 2.
Figure 4:
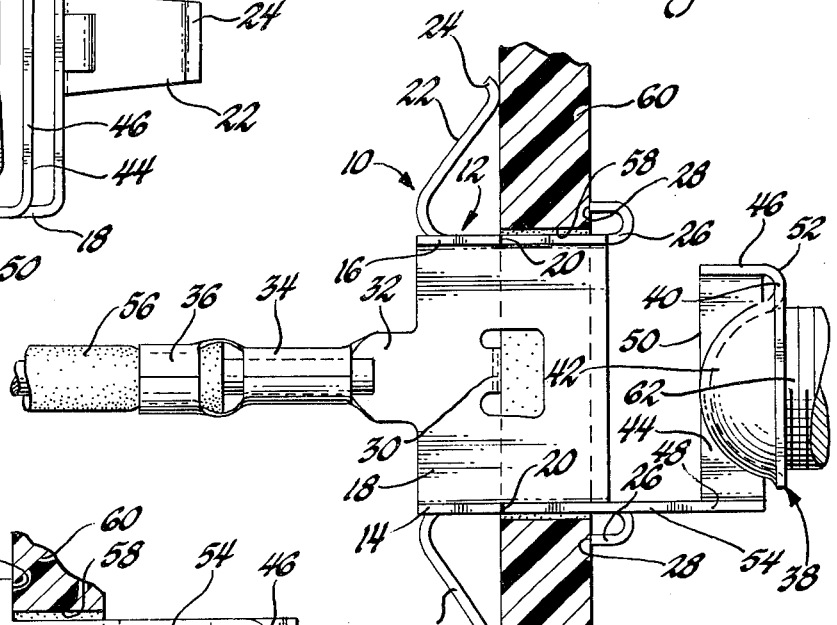
FIG. 4 is a top view of the electrical connector shown in FIG. 3 mounted in a support panel with an electrical lead attached and the butt contact terminal portion engaging a stud terminal.
Figure 5:
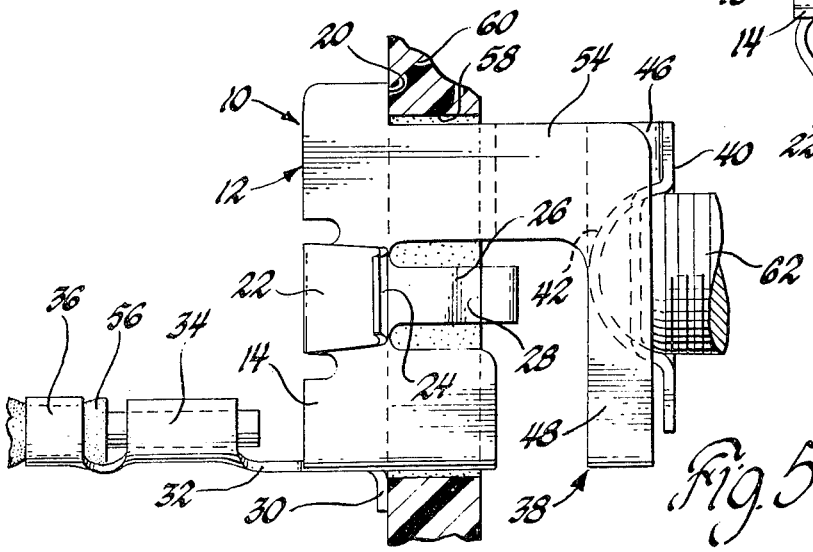
FIG. 5 is a side view of the connector, support panel and stud terminal shown in FIG. 4.

Referring now to FIGS. 4 and 5, the electrical connector 10 may first be crimped onto the end of an electrical lead 56 in conventional manner and then inserted into a hole 58 in a support panel 60 from the back side; the left hand side as viewed in FIGS. 4 and 5. In this regard it should be particularly noted that the frontal area of the butt contact terminal 40 and the U-shaped channel 44 is within the frontal area defined by the U-shaped mounting portion 12 so that the hole 58 need not be any larger than that necessitated by portion 12. See particularly FIG. 3.

The electrical connector 10 is inserted into the hole 58 and securely fastened to the panel in the following manner. After the channel portion 44 has passed through the hole 58, the rounded front faces of the spring arms 26 engage the left side of the panel 60 whereupon the spring arms 26 are cammed inwardly to pass through the hole. The movement of the connector 10 through the hole 58 continues until the stop shoulders 20 and tab 30 engage the left side of the panel 60 at which time the latch shoulders 28 are sprung outwardly and engage the right or front side of the panel. The back or left side of the panel is also biasingly engaged by the resilient wings 22 which prevent the electrical connector 10 from working loose from the panel 60.

The electrical connection 10 thus securely mounted on the panel 60 electrically connects the lead 56 to a stud terminal 62 of an instrument or other electrical device carried by an instrument panel or the like (not shown) disposed ahead of the mounting panel 60. Due to manufacturing variations in the several parts, the position of the stud terminal 62 with respect to the butt contact portion 40 of the connector 10 varies and consequently the butt contact portion 40 deflects toward the left to adjust for the various positions that the stud terminal 62 might take. More particularly the butt contact terminal portion 40 moves toward the left as seen in FIGS. 4 and 5 in response to an axial force applied in this direction by the stud terminal 62. Movement of the butt contact terminal portion 40 toward the securely mounted connector mounting portion 12 is accommodated by the compound twisting of the three legs 46, 48 and 50 of the U-shaped channel portion 44. More particularly, the leg 46 twists about its vertical axis along its length from the bottom where it connects with the leg 50 to the top free end where it is connected to the butt contact portion 40 by the bight 52; the leg 50 twists about its horizontal axis along its length to accommodate an axial displacement of the right end (as viewed in FIG. 3) toward the mounting portion 12; and the leg 48 twists about its vertical axis along its length from the top where it connects with the web 54 to the bottom where it connects with the leg 50. These individual twists of the leg are additive resulting in the axial displacement of the butt contact portion 40 toward the mounting portion 12. When displaced, the butt contact portion 40 remains substantially transverse to the mounting portion 12, however, some small universal movement is permitted thus enabling the dished central portion 42 to center on the rounded stud terminal 62. In some instances, the deflection of the web 54 in the manner of a cantilevered beam contributes to the axial displacement of the butt contact portion 40.

In practice we have found that an electrical connector stamped and bent from sheet metal stock about 0.012 inch thick will have a capability of the butt contact terminal portion deflecting up to approximately 0.2 inch when the channel portion is bent from a strip portion about 0.08 inch wide into a configuration where the parallel legs 46 and 48 are about 0.42 inch long and the bottom leg 50 is about 0.34 inch long. Thus the deflection characteristics of the butt contact terminal portion of an electrical connector in accordance with our invention are believed to be at least as good as and possibly better than those of the elongated leaf spring type referred to in the introduction while at the same time saving space.

Figure 1:
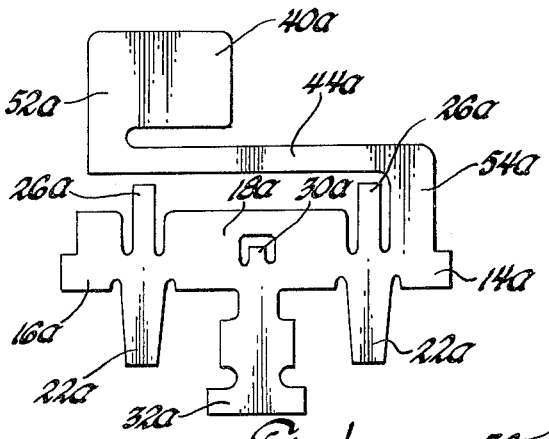
FIG. 1 is a plan view of a sheet metal stamping from which an electrical connector in accordance with this invention may be made.

The electrical connector may conveniently be made by bending the sheet metal stamping shown in FIG. 1. The correspondence between the several portions of the stamping and the electrical connector is readily apparent, however, for convenience many portions of the stamping are identical by adding the letter designation "*a*" to the identifying numberals for their counterparts in the electrical connector shown in FIGS. 2, 3, 4 and 5.

We wish it to be understood that we do not desire to be limited to the exact details of construction shown and described, for obvious modifications will occur to a person skilled in the art.

What is Claimed Is:

1. An electrical connector with a deflectable butt contact terminal portion comprising:

a unitary sheet metal stamping having a generally U-shaped mounting portion having substantially parallel leg portions and an interconnecting portion having a stop tab, each of said parallel leg portions having spring arms carrying latch shoulders and resilient wings whereby said connector is adapted to be snap mounted in a hole extending through a support panel and secured thereto by engagement with portions of the panel adjacent the hole and on opposite sides thereof, a generally U-shaped channel portion having a frontal area no greater than the frontal area of said mounting portion, said generally U-shaped channel portion further having first and second leg portions of equal length which are spaced from each other and substantially parallel, said leg portions having first and second end portions respectively at the free ends thereof, a web connecting said first end portion to said mounting portion, said web and said first end portion and a portion of one of said leg portions of said mounting portion being contiguous and substantially coplanar, a plate-like butt contact terminal portion disposed in a substantially perpendicular relationship to said second end portion and having a frontal area no greater than the frontal area of said mounting portion, said plate-like butt contact terminal portion having a central dished portion adapted to engage a rounded end of a stud terminal, and a bight portion constituting the sole means connecting said plate-like butt contact terminal portion to said second end portion whereby said terminal portion is deflectable toward said mounting portion and universally center on the rounded end of a stud terminal located at various distances from the mounting portion due to manufacturing variations by the resilient twisting of said channel portion.

* * * * *